US008234751B2

(12) United States Patent
Bushey et al.

(10) Patent No.: US 8,234,751 B2
(45) Date of Patent: Aug. 7, 2012

(54) SLIP OVER FURNITURE GUIDE

(76) Inventors: Richard D. Bushey, Kenosha, WI (US); Bret L. Bushey, Racine, WI (US)

( * ) Notice: Subject to any disclaimer, the term of this patent is extended or adjusted under 35 U.S.C. 154(b) by 951 days.

(21) Appl. No.: 11/034,509

(22) Filed: Jan. 11, 2005

(65) Prior Publication Data

US 2005/0183234 A1 Aug. 25, 2005

Related U.S. Application Data

(60) Provisional application No. 60/535,972, filed on Jan. 12, 2004.

(51) Int. Cl.
*A47B 91/04* (2006.01)

(52) U.S. Cl. ..... 16/42 R

(58) Field of Classification Search ..... 16/42 R, 16/18 CG, 42 T; 248/346.11, 188.4, 188.9; 297/239, 248; 135/77, 82
See application file for complete search history.

(56) References Cited

U.S. PATENT DOCUMENTS

| | | | | | |
|---|---|---|---|---|---|
| 1,903,609 | A | * | 4/1933 | Uhl | 16/42 R |
| 2,030,649 | A | * | 2/1936 | Miller | 16/42 R |
| 2,458,621 | A | * | 1/1949 | Miller | 16/42 T |
| 2,865,133 | A | * | 12/1958 | Hoven et al. | 248/188.9 |
| 2,921,760 | A | * | 1/1960 | Wheeler | 248/615 |
| 3,138,893 | A | * | 6/1964 | Rupar | 248/346.11 |
| 3,166,782 | A | * | 1/1965 | Miller | 16/42 R |
| 3,326,508 | A | * | 6/1967 | Born | 248/346.11 |
| 3,389,421 | A | * | 6/1968 | Wheeler | 16/42 R |
| 3,505,724 | A | * | 4/1970 | Sator et al. | 29/432.2 |
| 5,010,621 | A | * | 4/1991 | Bock | 16/39 |
| 5,191,676 | A | * | 3/1993 | Gerner | 16/42 T |
| 5,220,705 | A | * | 6/1993 | Bushey | 16/42 R |
| 5,426,818 | A | * | 6/1995 | Bushey | 16/42 R |
| 5,573,212 | A | * | 11/1996 | Palazzolo | 248/188.9 |
| D412,106 | S | * | 7/1999 | Kennard, IV | D8/402 |
| 5,945,178 | A | * | 8/1999 | Volkmann | 248/188 |
| 6,088,877 | A | * | 7/2000 | Swy et al. | 16/42 T |
| 6,134,747 | A | * | 10/2000 | Leibman | 16/24 |
| 6,155,530 | A | * | 12/2000 | Borgen | 248/188.9 |
| 6,405,982 | B2 | * | 6/2002 | Ferencz | 248/188.9 |
| 6,866,338 | B2 | * | 3/2005 | Mendenhall et al. | 297/239 |
| 6,869,052 | B2 | * | 3/2005 | Keast et al. | 248/188.9 |
| 6,901,629 | B2 | * | 6/2005 | Wurdack | 16/42 R |
| 6,910,246 | B2 | * | 6/2005 | Desmarais | 16/42 R |

* cited by examiner

*Primary Examiner* — Victor Batson
*Assistant Examiner* — Jeffrey O Brien
(74) *Attorney, Agent, or Firm* — Boyle Fredrickson, s.c.

(57) ABSTRACT

A furniture glide is provided that is receivable on a foot of a piece of furniture. The furniture glide includes a rentention boot including a bottom wall, upper wall and a sidewall that define a cavity for receiving the foot therein. The upper wall has a central opening therethrough that communicates with the cavity. A neck projects from the upper wall and extends about the opening. A slider bonded to the bottom wall of the retention boot to facilitate the sliding of the piece of furniture over a supporting surface such a floor or the like.

12 Claims, 2 Drawing Sheets

FIG. 3
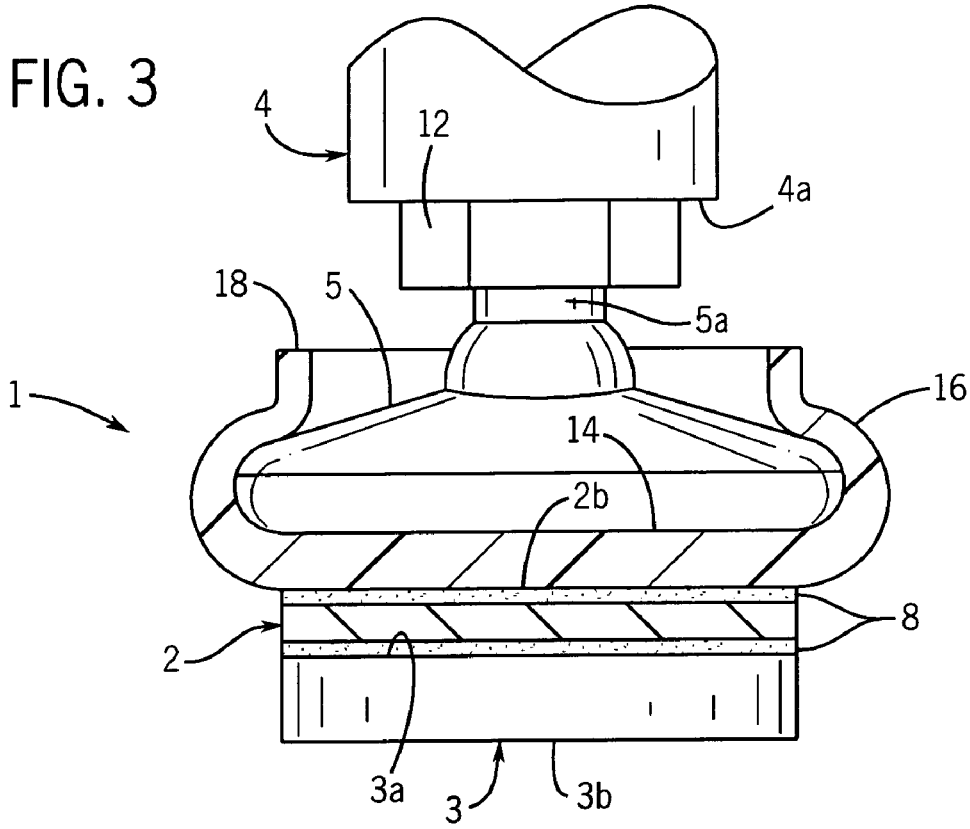
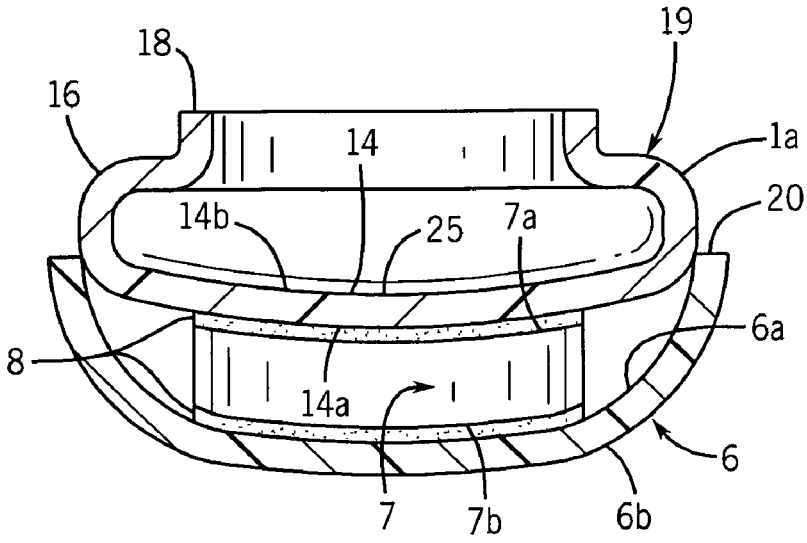
FIG. 5

SLIP OVER FURNITURE GUIDE

CROSS-REFERENCE TO RELATED APPLICATION

This application claims the benefit of U.S. Provisional Application Ser. No. 60/535,972, filed Jan. 12, 2004.

FIELD OF THE INVENTION

This invention relates generally to furniture glides, and in particular, to a slip over furniture glide that accommodates a foot threaded into a leg of a piece of furniture.

BACKGROUND OF THE INVENTION

Coasters are often used under the legs of a piece of furniture to act as a buffer between the legs and the floor on which the piece of furniture rests. Typically, coasters take the form of glass or rubber discs having flat bottoms that rest on the floor. By positioning the coasters between the furniture legs and the floor, the weight of the furniture leg is dispersed over a larger area such that the furniture leg does not scratch or mar the floor when the piece of furniture is moved or leave a depression in the floor when the piece of furniture remains in one place for an extended period of time.

In addition, furniture glides or sliders have been developed that are also positioned between the legs of a piece of furniture and the carpeting on which the piece of furniture rests. By way of example, Bushey, U.S. Pat. No. 5,220,705 discloses a furniture glide that facilitates the movement of a piece of furniture on carpeted and bare floors. The furniture glide includes a convo-convex disc having an arcuate convex lower surface, a concave upper surface defining a central cavity, and resilient pad fixed to the disc upper surface within the central cavity below the edge thereof. Adhesive is provided for securing the resilient pad to the bottom of the piece of furniture or to the leg of the piece of furniture.

While functional for their intended purpose, prior art furniture glides have certain limitations. More specifically, these furniture glides are designed for mounting onto the bottoms of pieces of furniture or on the legs thereof. As a result, the furniture glides do not fit properly on pieces of furniture that incorporate feet threaded into the bottoms thereof. Further, repeated movement of a piece of furniture along a floor may cause the furniture glide to become detached from the bottom of the piece of furniture. As a result, the furniture glide may become separated from the piece of furniture such that the bottom of piece of furniture may engage and damage the flooring. Therefore, it is highly desirable to provide a furniture glide and/or coaster that may be simply secured to a foot threaded into the bottom of a piece of furniture to prevent damage to the flooring on which the piece of furniture rests.

Therefore, it is a primary object and feature of the present invention to provide a furniture glide that may be securely retained on a foot threaded into the leg of a piece of furniture.

It is a further object and feature of the present invention to provide a furniture glide that is inexpensive to manufacture and simple to utilize.

It is a still further object and feature of the present invention to provide a furniture glide that may be utilized on a foot threaded into the leg of a piece of furniture to prevent damage to the flooring on which the piece of furniture sits.

In accordance with the present invention, a furniture glide is provided that is receivable on a foot of a piece of furniture. The furniture glide includes a retention boot defining a cavity for receiving the foot therein. The retention boot has a bottom wall having an upper surface partially defining the cavity and a lower surface. A slider element is bonded to the lower surface of the bottom wall of the retention boot.

The retention boot also includes a sidewall projecting from the bottom wall. The sidewall may have a generally concave cross section. The retention boot may also include an upper wall having a central opening therethrough. The central opening communicates with the cavity for allowing the foot of the piece of furniture to by inserted into the cavity. A neck projects from the upper wall and extending about the opening.

The slider element includes a disk having an upper surface bonded to the lower surface of the retention boot and a lower surface. The slider element also includes a floor engaging pad having an upper surface bonded to the lower surface of the disk and a lower surface engageable with a supporting surface. Preferably, the floor engaging pad is formed from felt.

In accordance with a further aspect of the present invention, a furniture glide is provided that is receivable on a foot of a piece of furniture. The furniture glide includes a retention boot including a bottom wall, upper wall and a sidewall that define a cavity for receiving the foot therein. The upper wall has a central opening therethrough that communicates with the cavity. A neck projects from the upper wall and extends about the opening. A slider is bonded to the bottom wall of the retention boot to facilitate the sliding of the piece of furniture over a supporting surface such a floor or the like.

The sidewall of the retention boot may have a generally concave cross section and the slider may include a disk having an upper surface bonded to the retention boot and a lower surface. The slider also includes a floor engaging pad having an upper surface bonded to the lower surface of the disk and a lower surface engageable with a supporting surface. Preferably, the floor engaging pad is formed from felt.

The bottom wall of the retention boot includes an upper surface communicating with cavity. The upper surface of the bottom wall of the retention boot may include a depression therein. In addition, the bottom wall of the retention boot may include a thickened portion for bearing the foot of the piece of furniture.

In accordance with a still further aspect of the present invention, a furniture glide is provided that is receivable on a foot of a piece of furniture. The furniture glide includes a retention boot that includes a bottom wall, an upper wall and a sidewall that defines a cavity for receiving the foot therein. The upper wall has a reinforced opening therethrough that communicates with the cavity. A slider is bonded to the bottom wall of the retention boot. The slider includes a backing layer and a floor engaging pad.

The sidewall of the retention boot may have a generally concave cross section and the slider may includes a backing layer having an upper surface bonded to the retention boot and a lower surface. The slider also includes a floor engaging pad having an upper surface bonded to the lower surface of the backing layer and a lower surface engageable with a supporting surface. Preferably, the floor engaging pad is formed from felt.

The bottom wall of the retention boot includes an upper surface communicating with cavity. The upper surface of the bottom wall of the retention boot may include a depression therein. In addition, the bottom wall of the retention boot may include a thickened portion for bearing the foot of the piece of furniture.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 3 is a side elevational view, partially in section, showing the furniture glide of FIG. 1 mounted on a foot of a leg of a piece of furniture;

FIG. 5 is a cross-sectional view of the furniture glide of FIG. 4.

DESCRIPTION OF THE PREFERRED EMBODIMENT

Figure 1:
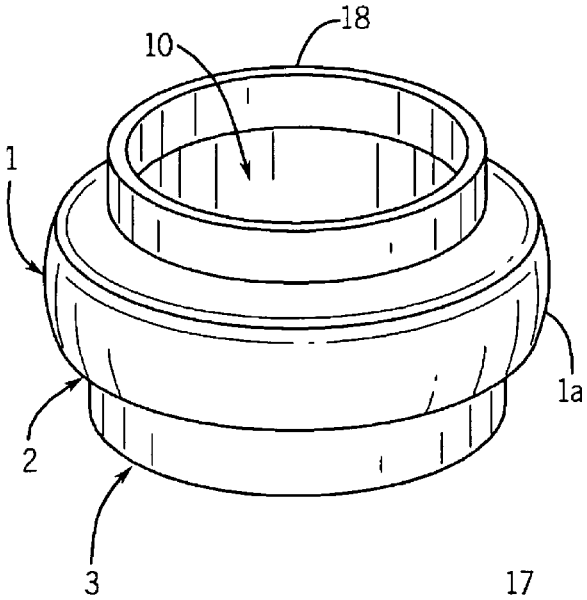
FIG. 1 is an isometric view of a furniture glide in accordance with the present invention.

Referring to FIG. 1, a furniture glide in accordance with the present invention is generally designated by the reference numeral 1. Furniture glide 1 includes a pliable retention boot 1*a* that defines cavity 10 for receiving foot 5 of furniture leg 4 therein. As is conventional, foot 5 includes shaft 5*a* threaded into bottom surface 4*a* of furniture leg 4. Nut 12 is positioned on shaft 5*a* such that rotation of nut 12 allows a user to adjust the vertical spacing between foot 5 and bottom surface 4*a* of furniture leg 4. Retention boot 1*a* further includes a generally flat bottom portion 14 having bulbous sidewall 16 projecting vertically therefrom.

Figure 2:
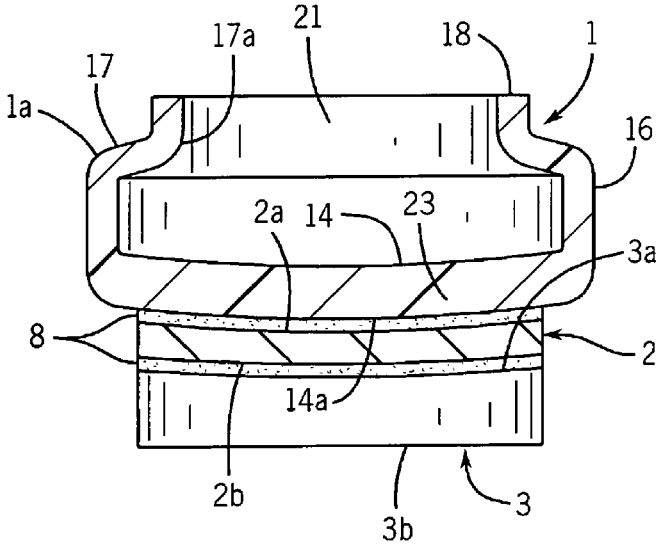
FIG. 2 is a cross-sectional view of an alternate embodiment of the furniture glide of FIG. 1.

As best seen in FIG. 2, sidewall 16 may be generally perpendicular to bottom portion 14 of retention boot 1*a* without deviating from the scope of the present invention. In the embodiment depicted in FIG. 2, retention boot 1*a* includes upper portion 17 spaced from and lying in a plane generally parallel to bottom portion 14. Upper portion 17 includes a radially outer edge that is integral with the upper edge of sidewall 16 and a radially inner edge 17*a* that defines opening 21 in retention boot 1*a* that communicates with cavity 10. Neck 18 projects vertically from inner edge 17*a* of upper portion 17 of retention boot la so as to reinforce inner edge 17*a* of upper portion 17 of retention boot 1*a* and prevent damage thereto during the insertion and removal of foot 5 into cavity 10. Alternatively, in the embodiments of FIGS. 1 and 3-5, neck 18 projects vertically from upper end of bulbous sidewall 16 so as to define an opening for allowing communication with cavity 10 within retention boot 1*a*.

Referring back to FIG. 2, it is contemplated for bottom portion 14 of retention boot 1*a* to include a thickened portion 23 for bearing the foot of the piece of furniture. By way of example, thickened portion 23 of bottom portion 14 may be centrally located therein. However, other portions of bottom portion 14 of retention boot 1*a* may be thickened without deviating from the scope of the present invention.

Referring to FIGS. 1-3 collectively, furniture glide 1 further includes pliable disk 2 having upper surface 2*a* bonded to bottom surface 14*a* of bottom portion 14 of retention boot 1*a*. Lower surface 2*b* of disk 2 is bonded to upper surface 3*a* of felt disk 3. It can be appreciated that lower surface 3*b* of felt disk 3 is intended to engage a supporting surface on which a piece of furniture is positioned. It is contemplated that upper surface 2*a* of disk 2 be bonded to the lower surface 14*a* of base portion 14 of retention boot 1*a* and lower surface 2*b* of disk 2 be bonded to upper surface 3*a* of felt disk 3 in any suitable manner such as by adhesive 8. Alternatively, such surfaces may be fused or embedded together.

Figure 4:
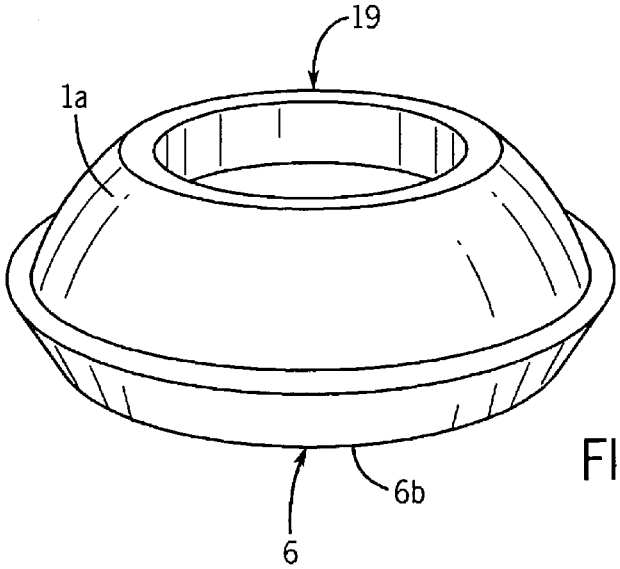
FIG. 4 is an isometric view of a still further embodiment of a furniture glide in accordance with the present invention.

Referring to FIGS. 4-5, an alternate embodiment of a furniture glide in accordance with the present invention is generally designated by the reference numeral 19. Furniture glide 19 includes retention boot 1*a* as heretofore described. As such, the description of retention boot 1*a* of furniture glide 1 is understood to describe retention boot 1*a* of furniture glide 19 as if fully described hereinafter.

Furniture glide 19 further includes pliable disk 7 having upper surface 7*a* bonded to lower surface 14*a* of base portion 14 of retention boot 1*a* and lower surface 7*b* bonded to inner surface 6*a* of a generally concave slider element 6. Slider element 6 includes outer surface 6*b* engageable with a supporting surface and outer periphery 20. Inner surface 6*a* adjacent outer periphery 20 of slider element 6 is spaced from retention boot 1*a* so as to allow limited vertical movement of slider element 6 with respect to retention boot 1*a* during compression and/or expansion of pliable disk 7. Pliable disk 7 is bonded to the lower surface 14*a* of base portion 14 of retention boot 1*a* and to inner surface 6*a* of slider element 6 in any suitable manner such as by use of adhesive 8. Alternatively, pliable disk 7 may be fused to or embedded with such surfaces.

As best seen in FIG. 5, it is contemplated to provide a centrally located depression 25 in upper surface 14*b* of bottom portion 14 of retention boot 1*a*. Depression 25 may overlap thickened portion 23 of bottom portion 14 of retention boot 1*a* as depicted in FIG. 2, or alternatively, bottom portion 14 of retention boot 1*a* may have the uniform thickness.

In operation, foot 5 of furniture leg 4 is inserted through the opening and retention boot 1*a* into cavity 10. Thereafter, the piece of furniture is deposited on a supporting surface such that lower surface 3*b* of felt disk 3 or lower surface 6*b* of slider element 6 engages such supporting surface.

Various modes of carrying out the invention are contemplated as being within the scope of the following claims particularly pointing out and distinctly claiming the subject matter which is regarded as the invention.

We claim:

1. A furniture glide receivable on a foot of a piece of furniture, comprising:

a retention boot defining a cavity for receiving the foot therein, the retention boot having:

an upper wall having a central opening therethrough and a lower surface, the central opening having a diameter and communicating with the cavity for allowing the foot of the piece of furniture to be inserted into the cavity;

a closed bottom wall having a diameter greater than the diameter of the central opening in the upper wall and an outer periphery, the bottom wall including a generally flat upper surface vertically spaced from and directed towards the lower surface of the upper wall so as to define the cavity therebetween and a lower surface; and a sidewall projecting from the outer periphery of the bottom wall to the upper wall, the sidewall having a generally concave cross section and a concave inner surface partially defining the cavity; and a slider element bonded to the lower surface of the bottom wall of the retention boot; the slider element including:

a pliable disk having an upper surface bonded to the lower surface of the bottom wall of the retention boot and a lower surface; and a floor engaging pad, the pad having an upper surface bonded to the lower surface of the disk and a lower surface engageable with a supporting surface wherein:

the retention boot is fabricated from a pliable material such that the foot of the piece of furniture having a diameter greater than the diameter of the central opening may be inserted to and removed from the cavity through the central opening in the upper wall.

2. The furniture guide claim 1 further comprising a neck projecting from the upper wall and extending about the opening.

3. The furniture glide of claim 1 wherein the floor engaging pad is formed from felt.

4. The furniture glide of claim 1 wherein the upper surface of the bottom wall of the retention boot includes a depression therein.

5. The furniture glide of claim 1 wherein the bottom wall of the retention boot includes a thickened portion for bearing the foot of the piece of furniture.

6. A furniture glide receivable on a foot of a piece of furniture, comprising:

a retention boot including a closed bottom wall lying on a first plane and having upper and lower surfaces, an upper wall having a central opening extending therethrough and a lower surface directed towards the upper surface of the bottom wall and a concave sidewall extending from an outer periphery of the bottom wall to the upper wall;

a neck projecting from the upper wall at an angle generally perpendicular to the first plane and extending about the opening; and a slider bonded to the lower surface of the bottom wall of the retention boot, the slider including:

a pliable disk having an upper surface bonded to the lower surface of the retention boot and a lower surface; and a floor engaging pad, the floor engaging pad having an upper surface bonded to the lower surface of the disk and a lower surface engageable with a supporting surface; and wherein:

the lower surface of the upper wall, the upper surface of the bottom wall and the concave sidewall define a cavity for receiving the foot therein;

the central opening in the upper wall has a diameter and communicates with the cavity; and the closed bottom wall of the retention boot has a diameter greater than the diameter of the central opening in the upper wall of the retention boot; and the retention boot is fabricated from a pliable material such that the foot of the piece of furniture having a diameter greater than the diameter of the central opening may be inserted to and removed from the cavity through the central opening in the upper wall.

7. The furniture glide of claim 6 wherein the floor engaging pad is formed from felt.

8. The furniture glide of claim 6 wherein the bottom wall of the retention boot includes a thickened portion for bearing the foot of the piece of furniture.

9. A furniture glide receivable on a foot of a piece of furniture, comprising:

a retention boot including a closed bottom wall having an upper surface and a lower surface, an upper wall having a reinforced opening extending therethrough and a lower surface directed towards the upper surface of the bottom wall, and a concave sidewall extending from an outer periphery of the bottom wall to the upper wall; and a slider bonded to the lower surface of the bottom wall of the retention boot, the slider including:

a backing layer having an upper surface bonded to the lower surface of the retention boot and a lower surface; and a floor engaging pad having an upper surface bonded to the lower surface of the backing layer and a lower surface;

wherein:

the lower surface of the upper wall, the upper surface of the bottom wall and the concave sidewall define a cavity for receiving the foot therein;

the reinforced opening in the upper wall has a diameter and communicates with the cavity;

the closed bottom wall of the retention boot has a diameter greater than the diameter of the reinforced opening in the upper wall of the retention boot; and the retention boot is fabricated from a pliable material such that the foot of the piece of furniture having a diameter greater than the diameter of the central opening may be inserted to and removed from the cavity through the central opening in the upper wall.

10. The furniture glide of claim 9 wherein the floor engaging pad is formed from felt.

11. The furniture glide of claim 9 wherein the bottom wall of the retention boot includes an upper surface communicating with cavity and wherein the upper surface of the bottom wall of the retention boot includes a depression therein.

12. The furniture glide of claim 9 wherein the bottom wall of the retention boot includes a thickened portion for bearing the foot of the piece of furniture.

* * * * *